US007466946B2

(12) United States Patent
Tsujita et al.

(10) Patent No.: US 7,466,946 B2
(45) Date of Patent: Dec. 16, 2008

(54) DEVELOPING UNIT AND IMAGE FORMING APPARATUS

(75) Inventors: Akio Tsujita, Ibaraki (JP); Kaoru Kataoka, Ibaraki (JP); Tatsuya Kubo, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 330 days.

(21) Appl. No.: 11/348,305

(22) Filed: Feb. 7, 2006

(65) Prior Publication Data

US 2006/0216069 A1 Sep. 28, 2006

(30) Foreign Application Priority Data

Mar. 25, 2005 (JP) ..... P2005-089141

(51) Int. Cl.
*G03G 15/09* (2006.01)

(52) U.S. Cl. ..... 399/269

(58) Field of Classification Search ..... 399/265, 399/267, 269, 272, 273, 275, 276
See application file for complete search history.

(56) References Cited

U.S. PATENT DOCUMENTS 4,266,868 A 5/1981 Bresina

2003/0143001 A1* 7/2003 Mitsuya et al. ..... 399/269

FOREIGN PATENT DOCUMENTS

| | | |
|---|---|---|
| JP | 53-77530 | 7/1978 |
| JP | 56-040551 | 4/1981 |
| JP | 63-24268 | 2/1988 |
| JP | 2003-215908 | 7/2003 |
| JP | 2005-043803 | 2/2005 |

* cited by examiner

*Primary Examiner*—Hoang Ngo
(74) *Attorney, Agent, or Firm*—McGinn IP Law Group, PLLC

(57) ABSTRACT

A developing unit includes a plurality of developing rolls over which a developer is conveyed and supplied onto an image carrier which is rotatably supported; and at least one pair of the developing rolls being adjacent to each other. In the pair of the developing rolls, one developing roll rotates in a direction opposite to a rotary direction of the image carrier, and the other developing roll rotates in the same direction of the rotary direction of the image carrier. A regulation member is interposed between the pair of the developing rolls. The regulation member regulates a conveyed amount of the developer. The regulation member is disposed to be opposed to a magnet which is provided within the two adjacent developing rolls. A polarity of the magnet in the pair of developing rolls opposed to each other is different from each other.

6 Claims, 4 Drawing Sheets

DEVELOPING UNIT AND IMAGE FORMING APPARATUS

CROSS-REFERENCE TO RELATED APPLICATIONS

This application is based on and claims the benefit of priority from the prior Japanese Patent Application No. 2005-089141, filed on Mar. 25, 2005; the entire contents of which are incorporated herein by reference.

BACKGROUND OF THE INVENTION

1. Field of the Invention

The present invention relates to a developing unit using a two-component developer and an image forming apparatus comprising the same.

2. Description of the Related Art

As the developing unit to be applied to image forming apparatus such as electrophotographic printer and copying machine there is widely used a developing unit using a two-component developer composed of a toner and a magnetic powder called carrier. When such a two-component developer is stirred in a developer receiving portion, the toner and the carrier in the developer are rubbed with each other so that they are each charged to a predetermined degree. The developer which has thus been charged to a predetermined degree is introduced from the developer receiving portion into a developing roll comprising a development sleeve and a plurality of magnetic poles fixed in the interior of the development sleeve. The developer which has been supplied onto the surface of the developing roll is then conveyed as the developing roll rotates while being retained in the form of magnetic brush. The developer passes by a regulation member called doctor blade disposed in the vicinity of the periphery of the developing roll. Thereafter, the developer is conveyed to a development region opposed to a photoreceptor which is an image carrier.

Various configurations of developing unit using a two-component developer have been proposed. In particular, a high speed process which operates at a rate of 300 mm/s or more is subject to shortage of developability of electrostatic latent image and thus often employs a hybrid process developing unit as a method of raising developability. The hybrid process developing unit comprises a plurality of developing rolls having different rotary directions disposed opposed to the development region. In order to explain the hybrid process developing unit, the terms "forward rotation developing roll" and "reverse rotation developing roll" will be used hereinafter for convenience. The term "forward rotation developing roll" as used herein is meant to indicate a developing roll which rotates counterclockwise if the rotary direction of the photoreceptor is considered clockwise. In other words, as viewed on the development region, both the photoreceptor and the forward rotation developing move in the same direction. On the contrary, the term "reverse rotation developing roll" as used herein is meant to indicate a developing unit which rotates clockwise if the rotary direction of the photoreceptor is considered clockwise. In other words, as viewed on the development region, both the photoreceptor and the reverse rotation developing roll move in the opposite directions.

Among configurations comprising a forward rotation developing roll and a reverse rotation developing roll in combination, a developing unit comprising a reverse rotation developing roll disposed upstream in the direction of rotation of the photoreceptor, a forward rotation developing roll disposed adjacent to the reverse rotation developing roll downstream in the direction of rotation of the photoreceptor, and a double-edged doctor blade disposed interposed between the reverse rotation developing roll and the forward rotation developing roll is particularly called fountain type developing unit. As mentioned above, the fountain type developing unit is advantageous in that it exhibits high developing properties. The fountain type developing unit is also advantageous in that it is little subject to the occurrence of defects such as image tail loss and head loss caused by the rotary direction of developing rolls. The fountain type developing unit is further advantageous in that it can work with only one double-edged doctor blade, making it possible to render itself compact.

A doctor blade is provided for the purpose of trimming the top of the magnetic brush formed by the developer retained on the surface of the developing roll to keep the amount of the developer to be conveyed to the development region at a proper value. The developer which has been regulated to a predetermined amount by the doctor blade is conveyed by the rotation of the developing roll into the development region where the developer on the developing roller is then brought into contact with the photoreceptor to develop the electrostatic latent image. During this procedure, a bias voltage is applied to the developing roller for introducing and supplying only the toner into the image forming area among the non-image area and the image forming area constituting the electrostatic latent image. In this manner, a toner image is formed on the image forming area of the photoreceptor.

It has heretofore been usual that the doctor blade is disposed interposed between the magnetic poles of the developing rolls in the fountain type developing unit. This reason for this arrangement is to raise the conveyability of the developer on the development roll. Another reason is attributed to the presumption that when the top of magnetic brush is trimmed at the position having a small magnetic force, the developer can be less stressed. However, with the recent demand for higher image quality, it has been desired to realize uniform development with a thin layer. Thus, there has been growing demand for the reduction and uniformalization of the regulated amount of the developer. To this end, the gap between the doctor blade and the developing roll (hereinafter referred to as "doctor gap") has been reduced more and designed more precisely.

The magnetic brush formed on the developing roll is arranged along the magnetic line of force. Therefore, in the region where the magnetic poles are opposed to each other, the magnetic brush is erected in the direction normal to the surface of the developing roll and thus is sparsely populated. In the region between magnetic poles, the magnetic brush lies down along the periphery of the developing roll and thus is densely populated. Accordingly, when the top of the magnetic brush is trimmed in the region between magnetic poles, the densely populated developer must be regulated. Thus, the change of the doctor gap has a great effect on the conveyed amount of the developer. Therefore, the doctor gap must be adjusted with a high precision.

In the case where the doctor blade is disposed opposed to the magnetic poles, on the other hand, the top of the magnetic brush is trimmed while it is erected in the direction normal to the surface of the developing roll and sparsely populated. Accordingly, even when the doctor gap is predetermined to be relatively great, the conveyed amount of the developer can be reduced. A method involving the predetermination of the doctor gap to a great value has been proposed as a method which allows the reduction of the effect of error in the adjustment of gap on the conveyed amount of the developer and hence stable realization of uniform development with a thin layer (e.g., JP-A-53-77530 and JP-A-63-24268). The development process using a doctor blade disposed opposed to the magnetic poles is referred to as "on-the-pole trimming development".

However, the on-the-pole trimming development process is disadvantageous in that the conveyed amount of the developer must be regulated with the magnetic brush sparsely erected in the direction normal to the surface of the developing roll, making it difficult to secure the uniformity in the developer kept erected. It has been heretofore devised to raise the width of the distribution of magnetic poles in the doctor blade zone. In particular, a high speed printing process (process rate: 300 mm/s or more) requires that the developer be conveyed at a high speed. Thus, both the high speed conveyance of the developer and the uniform conveyance of the developer cannot be attained at the same time. This causes deterioration of image quality such as unevenness in print density. Further, when a developer having a fluidity reduced by the reduction of the particle diameter of carrier is used, a problem of clogging of doctor gap with developer can easily occur.

SUMMARY OF THE INVENTION

The present invention has been made in view of the above circumstances and provides to uniformalize the regulated amount of the developer and prevent the deterioration of image quality such as unevenness in print density attributed to unevenness in the conveyed amount of the developer even if the on-the-pole trimming development process, which allows the regulation of the conveyed amount of the development to a low value even with a relatively great doctor gap, is used in a fountain type developing unit which is often used in a printing machine which operates at a high printing speed.

A developing unit includes a plurality of developing rolls over which a developer is conveyed and supplied onto an image carrier which is rotatably supported; and at least one pair of the developing rolls. The pair is adjacent to a developing roll which rotates in a direction opposite to a rotary direction of the image carrier and in the same direction of the rotary direction of the image carrier. The pair has a regulation member being interposed between the pair of the developing rolls. The regulation member regulates a conveyed amount of the developer. The regulation member is disposed to be opposed to a magnet which is provided within two adjacent developing rolls. A polarity of the magnet in the pair of developing rolls is opposed to each other are different from each other.

BRIEF DESCRIPTION OF THE DRAWINGS

These and other objects and advantages of this invention will become more fully apparent from the following detailed description taken with the accompanying drawings in which.

DESCRIPTION OF THE EMBODIMENTS

Embodiments will be described hereinafter. The arrangement that a polarity of the magnetic poles in a doctor blade zone between the adjacent forward rotation developing roll and reverse rotation developing roll are opposite causes the magnetic force to be transferred between the opposing magnetic poles, making it possible to form a stable magnetic field in the doctor blade zone. As a result, the developer can be kept stable (erected in the direction normal to the surface of the developing roll) in the doctor gap zone. By trimming the top of the magnetic brush under these conditions, the regulated amount of the developer can be uniformalized. On the contrary, when the on-the-pole trimming development process is effected with the polarity of the two opposing magnetic poles in the doctor blade zone being the same, the two opposing magnetic poles repel each other, making the magnetic field in the doctor blade zone unstable. As a result, the magnetic line of force in the doctor blade zone becomes unstable. Accordingly, the state of the developer in the doctor gap zone changes easily with the rotational eccentricity of the forward rotation developing roll or reverse rotation developing roll. Further, the regulated amount of the developer, too, is uneven, causing the occurrence of unevenness in image density.

In order to further stabilize the magnetic field between the doctor blade and the developing rolls, the doctor blade disposed opposed to the two adjacent developing rolls may be partially made of a magnetic material.

This is because the formation of a part of the doctor blade by a magnetic material causes a magnetic field to be formed between the magnetic field and the magnetic poles in the opposing developing rolls, making it possible to concentrate a magnetic field in the doctor gap zone.

The embodiments will be further described in connection with the attached drawings.

First Embodiment

Figure 1:
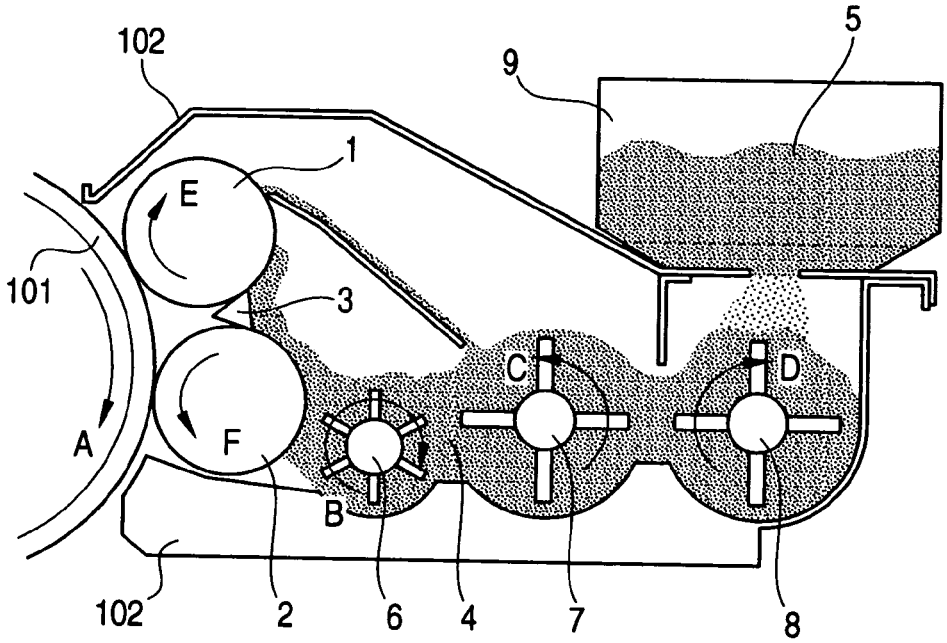
FIG. 1 is a diagrammatic view of a developing unit according to a first embodiment.
Figure 2:
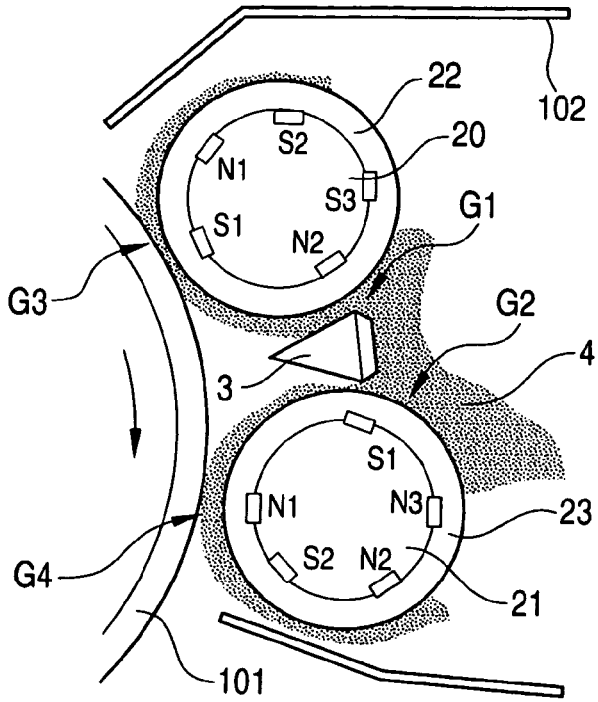
FIG. 2 is a diagrammatic view of a portion in the vicinity of doctor blade.

A first embodiment will be described in connection with FIGS. 1 and 2. FIG. 1 is a diagrammatic view of a developing unit according to the first embodiment. FIG. 2 is an enlarged view of a portion in the vicinity of a portion of a fountain type developing machine on which the developer is regulated by a doctor blade.

In FIG. 1, a developing unit 102 comprises a reverse rotation developing roll 1 and a forward rotation developing roll 2 disposed opposed to an image carrier called photoreceptor 101. As opposed to the photoreceptor 101 which rotates in the direction represented by the arrow A in the drawing, the reverse rotation developing roll 1 rotates in the direction represented by the arrow E while the forward rotation developing roll 2 rotates in the forward direction represented by the arrow F opposite that of the photoreceptor 101. While the present embodiment is described with reference to the case where as the image carrier there is used a drum-like photoreceptor, the image carrier may be a photoreceptor belt which turns on a specific track.

The developing unit 102 comprises a regulation member called doctor blade 3 disposed interposed between the reverse rotation developing roll 1 and the forward rotation developing roll 2. An image visibilizing agent called developer 4 has a positively-chargeable magnetic carrier and a powder called negatively-chargeable non-magnetic toner for forming a visible image on the photoreceptor 101. The non-magnetic toner is incorporated in the developer in a weight proportion of from 2% to 10% based on the total amount of the developer. In the printing operation, only the toner in the developer 4 is consumed to reduce the weight proportion of the toner in the developer in the developing unit 102. Therefore, the developing unit 102 comprises mixing/agitating members 7, 8 provided therein for mixing the toner 5 supplied from a toner reserving/supplying unit 9 into the interior of the developing unit 102 with the developer 4 with stirring. The mixing/agitating members 7, 8 are in the form of helical screw. The mixing/agitating members 7, 8 are rotated in the directions represented by the arrows C and D, respectively, to agitate the developer 4. The mixing/agitating member 7 rotates in the direction opposite that of the photoreceptor 101 while the mixing/agitating member 8 rotates in the same direction as that of the photoreceptor 101. When conveyed and agitated by the mixing/agitating members 7, 8, the toner in the developer 4 undergoes triboelectric charging with the carrier in the developer to a predetermined value. In the present embodiment, the charge of the toner is from −10 μC/g to −30 μC/g.

Thus, when the conveying member 6 rotates in the direction represented by the arrow B, the developer 4 containing a toner charged to a predetermined value is then conveyed over the upper side of the conveying member 6 from right side to left side as viewed on the drawing until it is introduced into the portion in the vicinity of the forward rotation developing roller 2. The rotary direction of the conveying member 6 is opposite that of the photoreceptor 101. The reverse rotation developing roll 1 and the forward rotation developing roll 2 each have magnets 20, 21 provided fixed therein, respectively, which are each magnetized such that N and S poles are alternately arranged as shown in FIG. 2. The reverse rotation developing roll 1 and the forward rotation developing roll 2 are provided with rotatable sleeves 22, 23, respectively, on the periphery thereof. In this arrangement, as the sleeve 23 rotates, the developer 4 present in the vicinity of the forward rotation developing roll 2 is conveyed to the doctor blade 3 by the magnetic force of the magnet 21.

Thereafter, the stream of the developer 4 is divided at the forward end of the doctor blade 3 into the reverse rotation developing roll 1 and the forward rotation developing roll 2 which are disposed adjacent thereto. The developer 4 then passes through the doctor gap formed by the two developing rolls and the doctor blade 3. During this procedure, the developer 4 is regulated in its flow rate by the passage regulating action of the doctor blade 3. Then, the developer 4 is introduced into the developing zone of the respective developing roll. The doctor blade 3 is made of a non-magnetic material (SUS material) having a blade at both ends thereof. As shown in FIG. 2, in order to regulate the passage of the developer 4 over the reverse rotation developing roll 1 and the forward rotation developing roll 2 to a predetermined value, the regulating position is predetermined such that the doctor gap G1 from the reverse rotation developing roll 1 and the doctor gap G2 from the forward rotation developing roll 2 are established.

Figure 8:
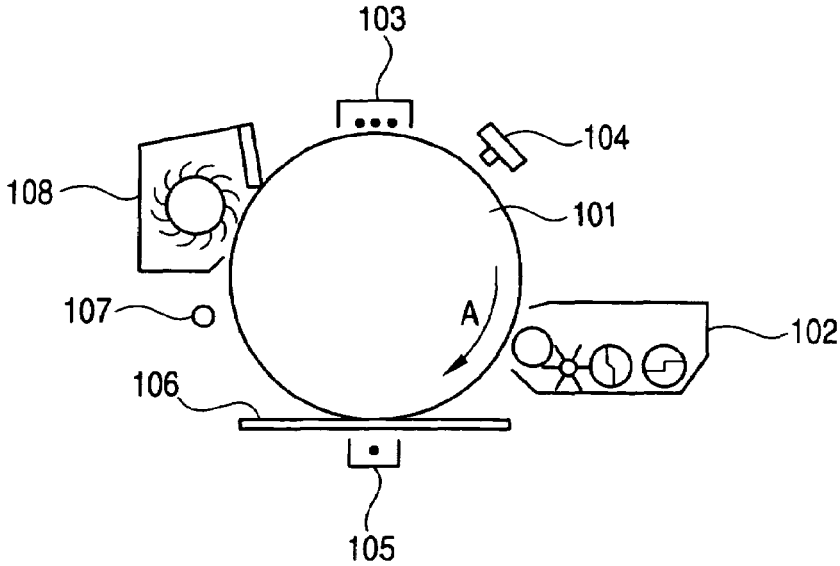
FIG. 8 is a diagrammatic view of an image forming apparatus to which the developing unit according to the embodiments is applied.

The image forming apparatus is diagrammatically shown in FIG. 8. The photoreceptor 101 is charged on the surface thereof by a charger 103. The charged surface of the photoreceptor 101 is then exposed to light from an exposing unit 104 according to an image data to form an electrostatic latent image thereon. The developer 4 which has been introduced into the development zone causes triboelectric charging on the surface of the photoreceptor 101 to form a toner image corresponding to the electrostatic latent image formed on the surface of the photoreceptor 101. Thereafter, the visible toner image on the photoreceptor 101 is transferred onto paper 106 by a transferring unit 105. The toner image is then fixed on paper 106 by a fixing unit (not shown). The charge on the photoreceptor 101 is erased by an erase lamp 107. The residual toner which has been left untransferred onto paper 106 is removed by a cleaning unit 108. The charger 103 may be a corona process or roller process charger. The exposing unit 104 may be an optical scanning process or LED process exposing unit. The transferring unit 105 may be a corona process or roller process transferring unit. The paper 106 may be a continuous paper or cut paper. The cleaning unit 108 may be a brush or blade. The fixing unit comprises a heating unit and a pressing unit. The heating unit and the pressing unit each may be either a roller process or belt process unit. The embodiments can be applied to a full-color image forming apparatus comprising a plurality of configurations shown in FIG. 8 in a tandem form for multicolor (yellow, magenta, cyan, black).

In order that the developing unit 102 might obtain predetermined development properties in the aforementioned continuous printing procedure, it is important that the regulation of the passage of the developer 4 by the doctor blade 3 is stably conducted. This method will be described in connection with FIG. 2.

In the embodiment, the doctor blade 3, which is a regulation member for the developer 4, is disposed opposed to the magnetic pole N2 (peak magnetic force: approx. 400 Gauss) of the reverse rotation developing roll 1 as well as the magnetic pole S1 (peak magnetic force: approx. 400 Gauss) of the forward rotation developing roll 2.

The developing unit 102 arranged such that the position at which the developer is regulated by the doctor blade 3 is fixed to the position of the magnetic poles in the reverse rotation developing roll 1 and the forward rotation developing roll 2 wherein the polarity of the opposing magnetic poles of the developing rolls are different from each other was mounted on a high speed printing apparatus (process rate: 500 mm/sec). Using a high density print pattern, a continuous printing experiment was then conducted to examine the development properties of the developing unit 102. The results will be given below.

The various conditions on printing experiment are as follows.

(Predetermined Conditions)

Photoreceptor: OPC drum (outer diameter: ϕ100 mm), peripheral speed: 500 mm/sec

Development sleeves 22, 23: Outer diameter: ϕ40 mm, peripheral speed: 600 mm/sec Doctor gap G1: 0.6 mm Doctor gap G2: 0.6 mm Development gap G3: 0.5 mm Development gap G4: 0.5 mm Developer 4: average particle diameter of carrier: 60 μm, average particle diameter of toner: 7 μm; toner mixing proportion: 2.5 wt-% (black toner)

Print pattern: 1 inch square solid patch (print density: 100%), 50% halftone (print density: 50%)

Figure 3:
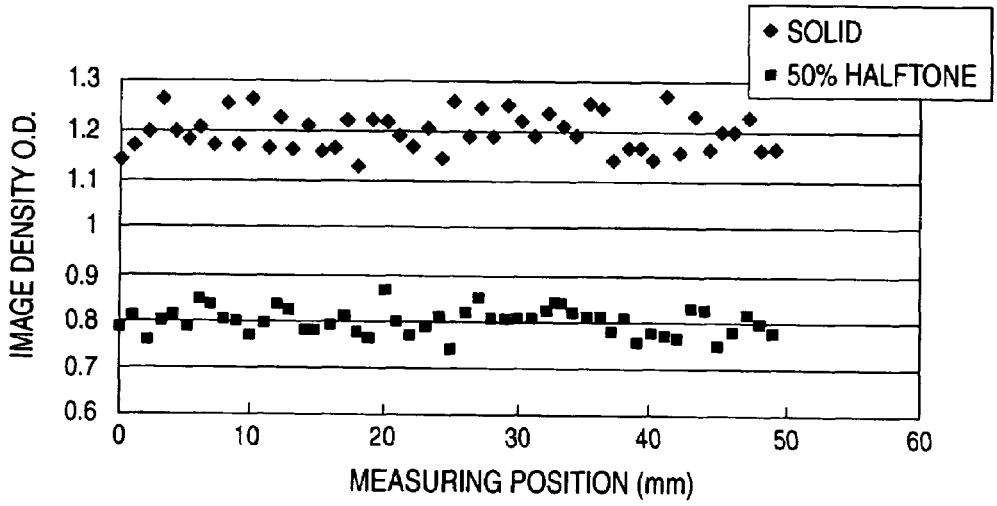
FIG. 3 is a graph illustrating the measurements of image density of a printed image printed under the development conditions of the first embodiment.

The measurements of image density of solid printing (print density: 100%) and 50% halftone printing during continuous printing experiment over 3,000 pages under the aforementioned conditions are shown in FIG. 3. The image density of the solid image was as good as O.D. 1.2 on the average (density change ΔO.D.: 0.1 or less) and the image density of the 50% halftone image was as good as O.D. 0.8 on the average (density change ΔO.D.: 0.08 or less). when more than 3,000 pages are continuously printed without stopping the printing, no clogging with the developer 4 occurred.

Second Embodiment

Figure 4:
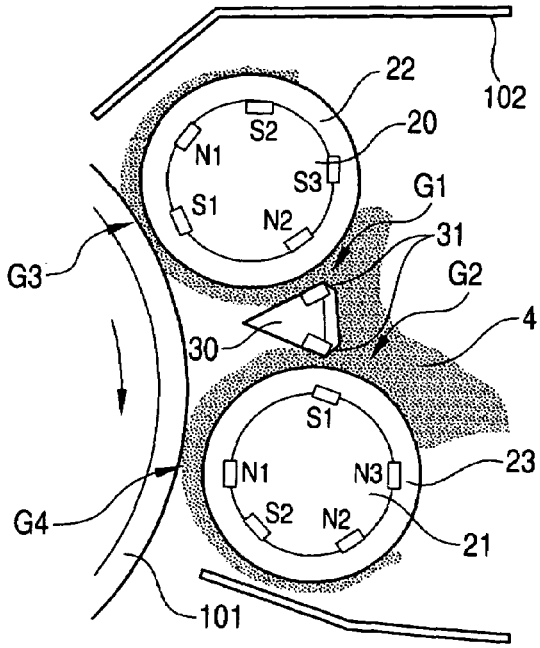
FIG. 4 is a diagrammatic view of a portion in the vicinity of the doctor blade according to a second embodiment.

FIG. 4 is a diagrammatic view of a developing unit comprising a doctor blade 30 having a magnetic material 31 made of iron provided in a part thereof wherein the magnetic material 31 is opposed to the magnetic pole N2 (peak magnetic force: approx. 400 Gauss) of the reverse rotation developing roll 1 as well as the magnetic pole S1 (peak magnetic force: approx. 400 Gauss) of the forward rotation developing roll 2 as in first embodiment. The matrix of the doctor blade 30 is SUS, which is a non-magnetic material. The magnetic material 31 is embedded in the doctor blade 3 at the both ends thereof opposed to the doctor gap.

Figure 5:
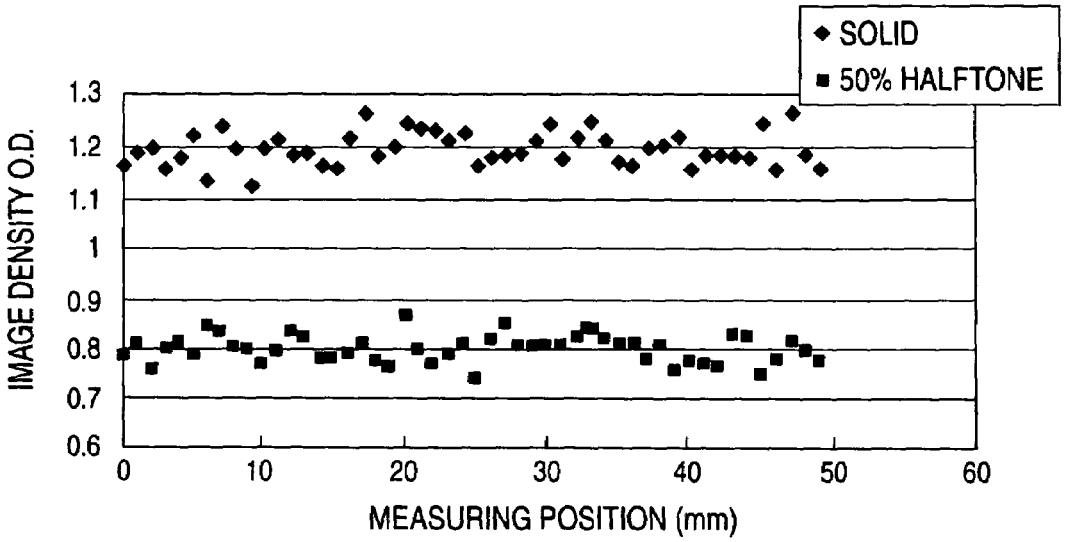
FIG. 5 is a graph illustrating the measurements of image density of a printed image printed under the development conditions according to a second embodiment.

The measurements of image density of solid printing (print density: 100%) and 50% halftone printing during continuous printing experiment using the same high speed printing machine according to the first embodiment with the aforementioned developing unit mounted thereon under the same conditions as in the first embodiment are shown in FIG. 5. The image density of the solid image was as better than the first embodiment as O.D. 1.2 on the average (density change ΔO.D.: 0.08 or less) and the image density of the 50% halftone image was as better than the first embodiment as O.D. 0.8 on the average (density change ΔO.D.: 0.06 or less). Referring to the results of 3,000 page continuous printing, no clogging with the developer 4 occurred. Thus, it was confirmed that the developer had been stably conveyed.

Third Embodiment

Figure 6:
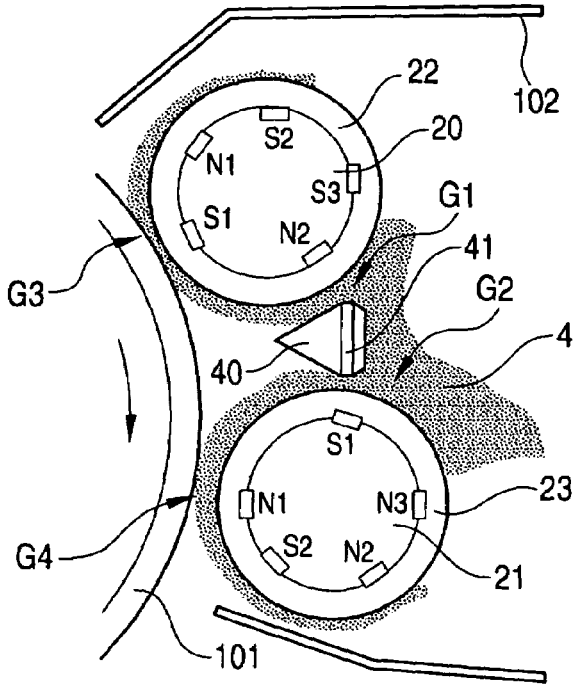
FIG. 6 is a diagrammatic view of a portion in the vicinity of the doctor blade according to a third embodiment.

FIG. 6 is a diagrammatic view of a developing unit comprising a doctor blade 40 having an iron magnetic material 41 provided in the center thereof interposed between non-magnetic materials wherein the iron magnetic material 41 is opposed to the magnetic pole N2 (peak magnetic force: approx. 300 Gauss) of the reverse rotation developing roll 1 as well as the magnetic pole S1 (peak magnetic force: approx. 300 Gauss) of the forward rotation developing roll 2 as in the first embodiment.

The doctor blade 40 having the aforementioned configuration has a simpler structure and thus can be more easily formed by working than the doctor blade 30 used in the second embodiment.

Figure 7:
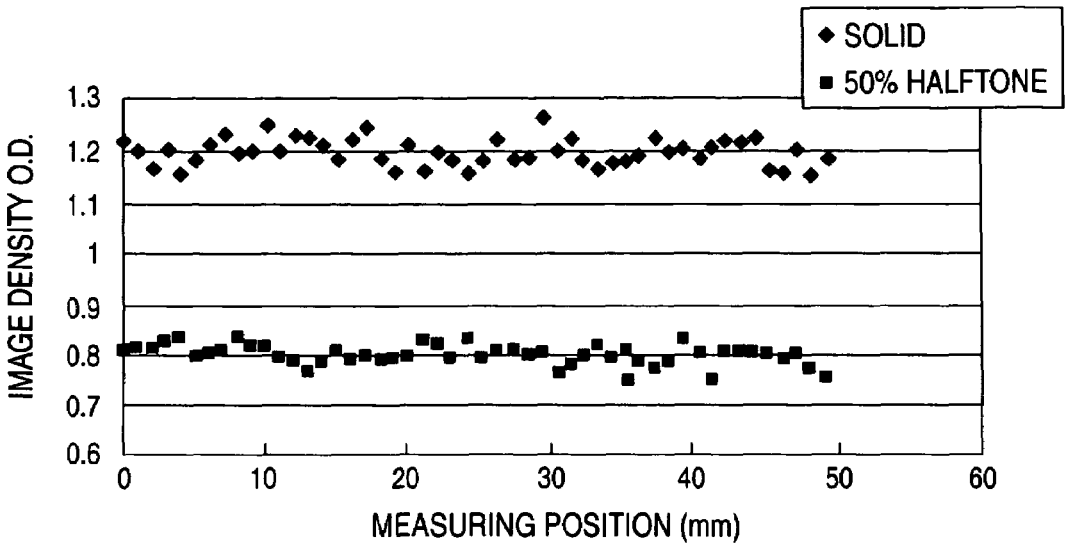
FIG. 7 is a graph illustrating the measurements of image density of a printed image printed under the development conditions according to a third embodiment.

The measurements of image density of solid printing (print density: 100%) and 50% halftone printing during continuous printing experiment using the same high speed printing machine as used in the first embodiment with the aforementioned developing unit mounted thereon under the same conditions as in the first embodiment are shown in FIG. 7. The image density of the solid image was as good as O.D. 1.2 on the average (density change ΔO.D.: 0.08 or less) and the image density of the 50% halftone image was as good as O.D. 0.8 on the average (density change ΔO.D.: 0.06 or less). Referring to the results of 3,000 page continuous printing, no clogging with the developer 4 occurred. Thus, it was confirmed that the developer had been stably conveyed.

In accordance with the embodiments, the doctor blade disposed in a fountain type developing machine comprising a forward rotation developing roll and a reverse rotation developing roll is opposed to the magnetic pole of the adjacent developing rolls wherein the opposing magnetic poles of the two developing rolls have different polarities. In this arrangement, magnetic force is transferred between the magnetic poles of the opposing developing rolls in the doctor blade zone. In this manner, the magnetic force in the doctor gap between the forward rotation developing roll and the reverse rotation developing roll can be stabilized, making it possible to realize stable transfer of the developer in the doctor blade zone. Even though the doctor gap is set to be large, a magnetic brush development can be stabilized so that a stress of the development is decreased. According to the embodiment, the doctor gaps G1 and G2 are set to be 0.6 mm, but the doctor gaps G1 and G2 maybe large until 1.1 mm. Accordingly, the occurrence of print defectives such as unevenness in image density due to dispersion of transferred amount of developer in the doctor gap zone can be prevented even with a full-color image forming apparatus requiring a high print density or an image forming apparatus having a high printing speed.

On the contrary, when the doctor blade disposed in the fountain type developing machine is opposed to the magnetic poles of the adjacent developing rolls wherein the opposing magnetic rolls of the two developing rolls have the same polarity, magnetic repulsion occurs between the opposing developing rolls in the doctor blade zone, causing the magnetic field to be distributed widely in the doctor gap. Thus, the magnetic force applied to the doctor gap zone can easily change. Therefore, the rotational eccentricity or rotary speed change of the two developing rolls causes the chain of developer particles in the doctor gap zone to change easily. As a result, the transferability of the developer in the doctor gap zone changes, causing easy occurrence of printing defects such as unevenness in image density. In particular, when as the developer there is used a small particle diameter carrier, clogging of the doctor blade portion with the developer can occasionally occur because the fluidity of the developer is much subject to the effect of environment, etc.

Further, the provision of a magnetic material in a part of the doctor blade causes the concentration of magnetic field in the magnetic material, making it possible to further stabilize the magnetic force in the doctor gap zone. As a result, the amount of the developer to be regulated between the doctor blade and the developing rolls can be further stabilized.

In the case where the doctor blade is entirely made of a magnetic material, a magnetic field is generated also in the zone other than the doctor blade gap to raise the magnetic force of the doctor gap zone. However, the effect of converging magnetic force is so small that the effect of providing stable conveyance of the developer in the doctor gap zone is small.

According to the embodiments, the developing unit comprising a forward rotation developing roll and a reverse rotation developing roll, the magnetic force in the doctor gap zone can be stabilized, making it possible to realize stable conveyance of the developer in the doctor blade zone. Accordingly, the occurrence of print defects such as unevenness in image density due to dispersion of the conveyed amount of the developer in the doctor gap zone can be prevented even with a full-color image forming apparatus requiring a high print density or an image forming apparatus which operates at a high printing speed.

What is claimed is:

1. A developing unit comprising:

a plurality of developing rolls over which a developer is conveyed and supplied onto an image carrier which is rotatably supported; and at least one pair of the developing rolls being adjacent to a developing roll which rotates in a direction opposite to a rotary direction of the image carrier and in the same direction of the rotary direction of the image carrier, the pair of the developing rolls having a regulation member being interposed between the pair of the developing rolls, the regulation member regulating a conveyed amount of the developer, the regulation member being disposed to be opposed to a magnet which is provided within two adjacent developing rolls, wherein a polarity of the magnet in the pair of developing rolls is opposed to each other are different from each other, wherein a magnetic material is provided in a part of the regulation member disposed opposed to the magnet in the pair of developing rolls.

2. The developing unit according to claim 1, wherein the magnetic material is provided in the regulation member is interposed between non-magnetic materials.

3. An image forming apparatus comprising:

an image carrier;

a charging unit charging a surface of the image carrier;

an exposing unit exposing the charged surface of the image carrier to light according to an image data, a transferring unit transferring the toner image to paper, a developing unit forming a toner image on the surface of the image carrier thus exposed, the developing unit having a plurality of developing rolls over which a developer is conveyed and supplied onto an image carrier which is rotatably supported; and at least one pair of the developing rolls being adjacent to a developing roll which rotates in a direction opposite to a rotary direction of the image carrier and in the same direction of the rotary direction of the image carrier, the pair of the developing rolls having a regulation member being interposed between the pair of the developing rolls, the regulation member regulating a conveyed amount of the developer, the regulation member being disposed to be opposed to a magnet which is provided within two adjacent developing rolls, wherein a polarity of the magnet in the pair of developing rolls is opposed to each other are different from each other, wherein a magnetic material is provided in a part of the regulation member disposed opposed to the magnet in the pair of developing rolls.

4. The image forming apparatus according to claim 3, wherein the magnetic material provided in the regulation member is interposed between non-magnetic materials.

5. The image forming apparatus according to claim 3, wherein the process rate is 300 mm/s or more.

6. The image forming apparatus according to claim 4, wherein the process rate is 300 mm/s or more.

* * * * *